United States Patent [19]

Davitz

[11] 4,424,908

[45] * Jan. 10, 1984

[54] CUSTOM CHANGEABLE, KNOCKDOWN SHELF

[75] Inventor: Walter E. Davitz, Columbus, Ohio

[73] Assignee: Production Plus Corporation, Columbus, Ohio

[ * ] Notice: The portion of the term of this patent subsequent to Jun. 6, 1998 has been disclaimed.

[21] Appl. No.: 201,492

[22] Filed: Oct. 28, 1980

Related U.S. Application Data

[63] Continuation-in-part of Ser. No. 41,944, May 29, 1979, Pat. No. 4,243,146.

[51] Int. Cl.[3] ..... A47F 5/01

[52] U.S. Cl. ..... 211/118; 108/149; 211/186

[58] Field of Search ..... 211/113, 118, 186; 108/149

[56] References Cited

U.S. PATENT DOCUMENTS 550,830 12/1895 Kunkel ..... 211/150 X
4,243,146 1/1981 Davitz ..... 211/118

FOREIGN PATENT DOCUMENTS 195717 4/1923 United Kingdom ..... 108/149
2044092 10/1980 United Kingdom ..... 211/118

*Primary Examiner*—Ramon S. Britts
*Assistant Examiner*—Robert W. Gibson, Jr.
*Attorney, Agent, or Firm*—Frank H. Foster

[57] ABSTRACT

A suspended shelf having hangers which support horizontal panels. The shelf hangers have a plurality of horizontal, vertically spaced crossbars each constructed of a U-shaped, downwardly opening channel member having a pair of side panels and a cross web connecting the panels extending between and longitudinally along the panels. A plurality of crossbeams, at least one near each end of each crossbar, extend between the panels and are spaced below the cross web. A plurality of manually removable sidebars extend between the adjacent vertically spaced ends of the crossbars. Each sidebar has a hook-shaped upper end for hanging over an upper one of the crossbeams and a lower, inwardly bent leg which extends along the underside of the cross web and above the crossbeam of a relatively lower crossbar to a downturned tip. Another pair of sidebars extend up from the uppermost crossbars and are fastened to the ceiling or other shelf support. A removable retaining means is inserted between each of the lower legs on the sidebar and its associated crossbeam for extending from the crossbeam to the leg for preventing significant movement of the leg and for interfering with the downturned tip to prevent withdrawal of the leg from the sidebar.

5 Claims, 13 Drawing Figures

CUSTOM CHANGEABLE, KNOCKDOWN SHELF

TECHNICAL FIELD

This is a continuation in part of my copending application Ser. No. 041,944, filed May 29, 1979, now U.S. Pat. No. 4,243,146.

This invention relates to suspended shelving using end hangers which are fabricated of metal and used for supporting such things as books, industrial inventory, displays and the like. The end hangers support horizontal shelf panels, such as boards. They have interchangeable sidebars and can be prefabricated in a variety of sizes and used to assembly shelves of customized sizes which can be changed as desired by the owner.

BACKGROUND ART

Shelving usually has several vertically stacked, horizontal surfaces for supporting objects which are connected by vertical columns or panels. However, it is often desirable to have easily installed shelving which can be rapidly changed to vary the spacing between the shelves. This may be desirable, for example, for accommodating a new inventory of objects of a different height. The shelves may be called upon to perform many jobs. However, each job is somewhat unique. Not only do objects vary in size from job to job, but they may come in different types of groupings of sizes and configurations. For example, objects can be large or small, elongated, bulky or compact.

It is desirable that all objects which are to be stored be supported as closely together as possible. By positioning the objects closer together on the shelf, there is less wasted empty or open area between the objects.

Prior art shelves are conventionally welded, screwed, nailed or bolted together. Welding irrevocably commits the particular shelf and the capital investment which is required to one unique size and spacing. The use of exposed bolts has the same effect because they can not be readily unfastened without substantial labor for disassembly of the shelf. Although the shelf may be excellent for one job it will be less efficient for most others. It is therefore an object of the present invention to provide a sturdy and durable support shelf which the owner can purchase and thereafter change as he desires in order to space the shelves to efficiently accomodate each particular group of objects being stored.

Still another object of the present invention is to provide a shelf constructed of components which can be prefabricated and warehoused and later assembled as needed. The required components may be selected in accordance with a purchase order to form shelves of a particular desired size. Not only may the shelves be shipped immediately because no further construction is necessary, but they may be shipped in a disassembled condition and therefore may be shipped in a very compact package which saves shipping expenses.

Additionally, it is an object of the invention to provide shelf sidebars in a variety of sizes so that different sizes may be used to assemble and change the shelves with a different vertical crossbar spacing. A user need only stock a variety of relatively inexpensive sidebars at considerably less cost than stocking a variety of entire shelves and yet can have the same variety of shelf sizes available to him.

BRIEF DISCLOSURE OF THE INVENTION

The present invention is a shelf, in its operable position having a plurality of generally horizontal, vertically spaced crossbars each crossbar formed, for example, as a narrow inverted, U-shaped, channel member with opposed spaced panels. Each crossbar includes a cross web connected between and extending longitudinally along the crossbar panels and at least one crossbeam near each end of the crossbar extending between the panels and spaced from the cross web. A plurality of manually removable sidebars extend between the adjacent, vertically spaced ends of the crossbars, each sidebar preferably having a hook-shaped upper end for hanging over an upper one of the crossbeams and a lower inwardly bent leg extending along the underside of a cross web and above a crossbeam of a relatively lower one of the crossbars to a downturned tip. Two similar sidebars extend upwardly from the uppermost crossbar into attachment with a ceiling or other shelf support. A removable retaining means is inserted between each lower leg and its associated crossbeam. The retaining means extends essentially from the crossbeam to the leg for preventing significant movement of the leg and for interfering with the turned down tip to prevent withdrawal of the leg. The retaining means may be a variety of configurations including the upper hook-shaped end of another removable sidebar which extends down to a still lower crossbar. For the bottom crossbar, the retaining means may be the upper rack engaging portion of a support hook. Still other retaining means are disclosed. Horizontal shelf panels such as boards are supported on the crossbars.

DESCRIPTION OF THE PREFERRED EMBODIMENT

Figure 1:
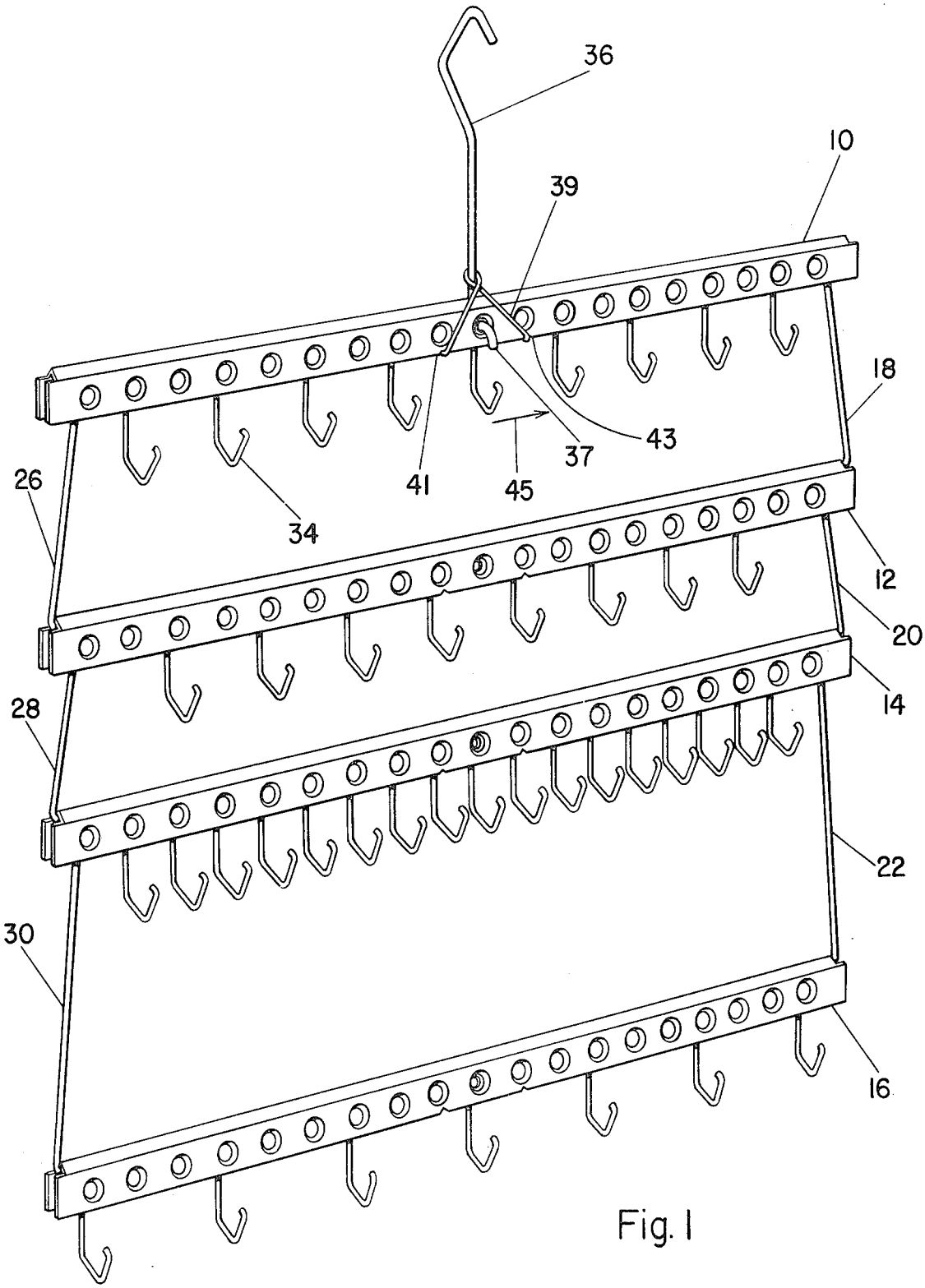
FIG. 1 is a view in perspective of a finishing support rack embodying the shelf support hanger structure of the present invention.

FIG. 1 illustrates a finishing support rack which has crossbeams and sidebars constructed in accordance with the principles of the present invention. It comprises a plurality of generally horizontal, vertically spaced crossbars 10, 12, 14 and 16 and a plurality of manually removable sidebars 18, 20, 22, 26, 28 and 30 and which extend between the adjacent, vertically spaced ends of the crossbars 10 through 16.

A plurality of workpiece support hooks, such as support hook 34, are connected at spaced intervals along the crossbars. Workpieces are hung upon these hooks for transporting the workpieces through the finishing system. Preferably, all of these parts are constructed of steel although other metals may be preferable for some uses, such as copper for the plating industry. The upwardly extending conveyor hook 36 is connected to the uppermost crossbar 10 for engaging the conveyer system of the finishing system and supporting the rack as it travels through the finishing system.

Figure 3:
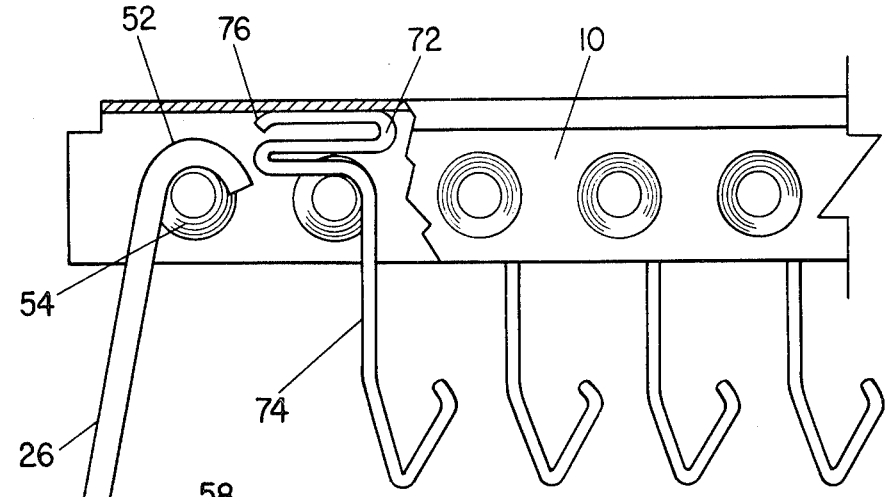
FIG. 3 is a view in vertical section taken substantially along the line 3—3 of FIG. 2.
Figure 3:
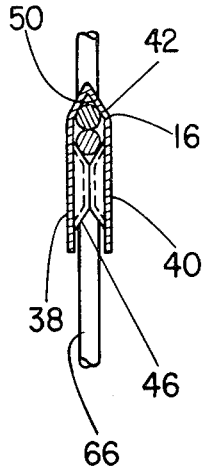
Figure 2:
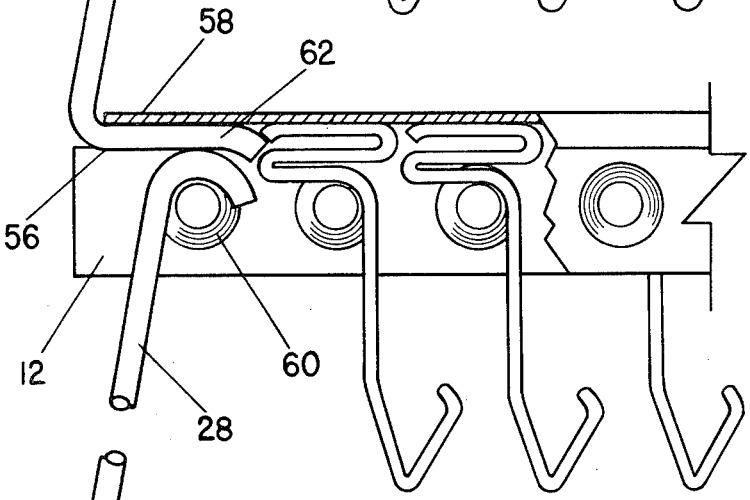
FIG. 2 is a view of a portion of the support rack illustrated in FIG. 1 with segments removed to illustrate the interconnection of the sidebars, crossbars and support hooks embodying the present invention.

Referring now to FIGS. 2 and 3, the preferred crossbars each comprise a horizontal, downwardly opening, U-shaped channel member such as the channel member of crossbar 16. The channel member includes a pair of spaced panels or legs 38 and 40 which are connected by a cross web 42 at the top of the crossbar extending longitudinally along the panels 38 and 40. A plurality of crossbeams, such as crossbeam 44, are connected between the panels or legs 38 and 40. The crossbeams are arranged longitudinally along each crossbeam and are spaced from each other and spaced below the cross web 42. The endmost crossbeams of each crossbar are normally used primarily for engaging the sidebars constructed in accordance with the present invention.

Although the crossbeams can be constructed in a variety of structural forms, such as bolts or rods welded in opposing holes, I prefer to form these crossbeams from a pair of opposite, inwardly tapering, frusto-conical projections or bosses which are embossed into the panels of channel members. These bosses or projections are connected together, for example by spot welding or metal stitching, to form an annular beveled groove, such as groove 46, around each crossbeam.

Attaching these bosses together to form the crossbeam in this manner not only prevents the separation of these bosses when they are engaged with the hooks or the sidebars and the support rack is loaded down with workpieces as described below, but this attachment also improves the rigidity and strength of the crossbars so that they resist deflection from the weight of the workpieces which are hung upon the hooks.

Typically, nineteen crossbeams are formed on each crossbar. However, they may be formed at any desired spacing or at irregular spacings in any desired numbers. For example, there may be different spacings in a single rack for accommodating the painting of different but similarly colored parts of a single assembly.

Each crossbar may be formed from a single, flat sheet which is embossed with the frusto-conical projections and then bent around to the U-shaped configuration. In so doing, it is preferred that the cross web of the channel member be formed to taper inwardly and upwardly to form an interior bevelled groove. As described below, this interior bevelled groove, such as groove 50, along with the annular bevelled grooves which are formed around each of the crossbeams, provide receiving seats for the interlocking sidebars and for the crossbar engaging portion of each of the support hooks. Although not essential, these grooves retain the sidebars and also the support hooks in the center of the crossbars and restrain them from lateral movement or side play toward the panels of the U-shaped crossbars.

Each of the sidebars, such as sidebar 26, has a hook-shaped upper end 52 for hanging over an upper one of the crossbeams, such as crossbeam 54. The sidebar 26 like the other sidebars has a lower, inwardly bent leg 56 which extends along the underside of the cross web 58 of the relatively lower crossbar 12 and above the crossbeam 60. The sidebar then is bent into a down turned tip 62.

A removable retaining means is inserted between the lower leg 56 and its associated crossbeam 60 for extending from the crossbeam 60 to the leg 58 for preventing significant movement of the leg 58 and preferably for holding it in place. The retaining means also interferes with the down turned tip 62 to prevent the withdrawal of the leg.

The removable retaining means may be in a variety of many different shapes. If there is to be a still lower crossbar in the finishing support rack, then the retaining means is the hook-shaped upper end of yet another sidebar, such as sidebar 28, which extends downwardly to the next lower crossbar 14.

However, a convenient removable retaining means for the bottom sidebar 16 is the upper, hook-shaped, crossbar engaging portion 64 of a workpiece support hook 66 or a piece of similarly sized bar stock which terminates below the phantom line 67 and serves only as a retaining means for the bottom crossbar. Preferably, the hook-shaped portion of both the support hook 66 and the sidebar 28 are formed of bar stock having a diameter such that they fit between the lower leg of the relatively higher sidebar and the associated crossbeam with only a minimum of excess clearance which is sufficient to allow easy insertion and removal.

However, another and very convenient removable retaining means is the rack engaging portion of the support hooks. Each of the support hooks has a workpiece engaging portion, such as the workpiece engaging portion 74, and a crossbar engaging portion, such as crossbar engaging portions 72.

In order to provide a conveyor hook 36 which is conveniently, manually removable and yet operably sturdy, I have provided a central bore 37 through the centermost crossbeam of each crossbar and have bent the lower end of the conveyor hook 36 into a double right angle to form a crank which is inserted through the bore 37 and held in place on the crossbar 10 by means of a wire brace 39.

Notches, such as notches 41 and 43, are formed symmetrically of this central bore 37 in the bottom edges of the sidebars. I prefer to provide four notches, two on each edge, and a central bore in each crossbar so that each crossbar is available for use as the top crossbar or as a lower crossbar of the support rack. The wire brace 39 is looped around the conveyor hook 36 and extends downwardly at each end to a sharp, inwardly turned hook which is caught in the notches, such as notches 41 and 43. The wire is biased by its own resilience into the notches. The notches are positioned so that the wire can be removed by merely pivoting it in the direction shown by arrow 45, to remove it from the notch to release the wire and thereby easily permit its removal from the conveyor hook 36. Conveyer hooks may be supplied in different lengths and the hook portion may be parallel to the plane of the rack or transverse thereto. After the racks have been coated a few times the conveyer hooks will not be removable, except after stripping, because they and the wire braces will be coated The workpiece engaging portion of each support hook is customarily bent into a hook-shaped end but also may be in any other configuration suitable for engaging and supporting particular workpieces. Often this portion is custom designed to accommodate particular problems with particular workpieces. It may, for example, extend laterally of the support rack or it may extend forwardly to hold the workpieces out and away from the rack.

The crossbar engaging portion of each support hook extends upwardly between the panels or legs of the crossbar and into engagement with and extending partially around a crossbeam. Preferably, each support hook is a metallic rod made of steel or other metal bar stock and formed into partially surrounding engagement with a crossbeam. Thereafter, the rod is bent to loop around into one or more and preferably two loops to extend into engagement against the cross web.

The crossbar engaging portion of each support hook is resiliently flexible so that it may be compressed for insertion between its associated crossbeam and the cross web and then released to apply oppositely directed resilient forces against the cross web and the crossbeam. These resilient forces releasably retain the support hooks in the crossbar.

Preferably, the hook engages the cross web in at least two places which are spaced apart on laterally opposite sides of the crossbeam. This prevents the accidental pivoting of the support hooks about the crossbeams which would allow them to fall out of the rack. Preferably, the support hook extends linearly along the inner surface of the cross web as illustrated in FIG. 2 and has a backturn 76 to facilitate insertion and removal.

There are a variety of alternative ways of forming the rack engaging portion of the support hooks and some of these are illustrated in my copending patent application.

The support hooks may be easily and quickly removed from the main frame of the support rack and yet in operation are held in position with minimal movement. The workpiece engaging portion of the support hook may be grasped, pivoted and either lifted upwardly to raise the bend above the crossbeam and then slid sideways or merely pivoted in a clockwise direction. The entire support hook in then lowered out of the crossbeam. Hooks are replaced in the opposite sequence. The hooks are easily removed by moving a bar or a tool longitudinally along the crossbar to pivot the hooks out of their clamped engagement in the crossbar.

Figure 4:
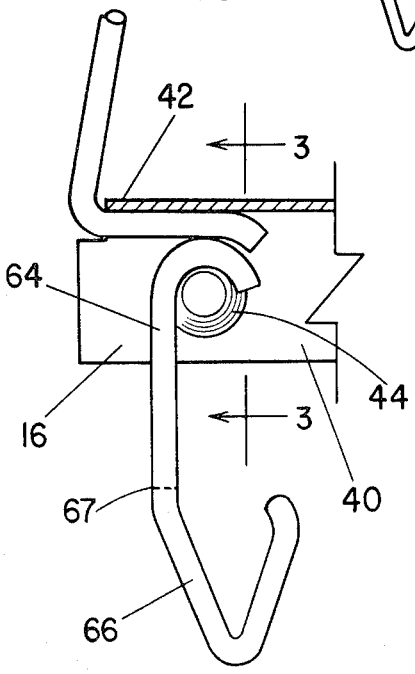
FIG. 4 is a view in vertical section illustrating an alternative embodiment of the present invention.
Figure 4:
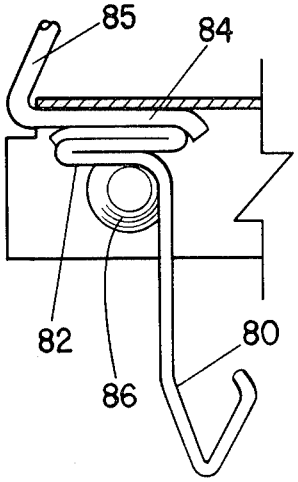

The resilient, compressible, rack engaging portion of the support hooks has a configuration and operation which permits them to be conveniently used as the retaining means to retain the lower legs of the sidebars rigidly in position. Referring to FIG. 4, a support hook 80 having a double looped, rack engaging portion 82 is inserted between the lower leg 84 of the sidebar 85 and the crossbeam 86. It may be inserted or removed in the same manner as it would be inserted if there was no sidebar leg 84. However, its oppositely directed forces are now directed not only against the crossbeam 86 but against the leg 84 of the sidebar to hold it rigidly in place.

Figure 5:
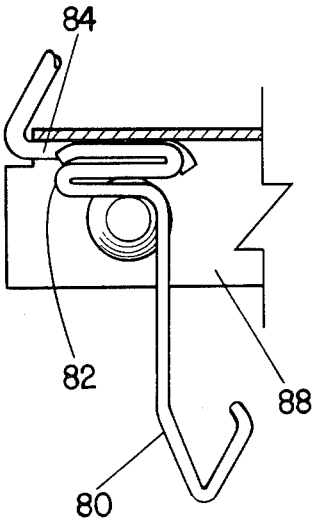
FIG. 5 is a view in vertical section of the embodiment of the invention illustrated in FIG. 4 in a slightly different position.

As illustrated in FIG. 5, the rack engaging portion 82 of the support hook 80 may slip to one side or the other of the sidebar leg 84 because the support hook 80 may be formed of a considerably smaller diameter bar stock. However, this is no problem because the uppermost portion of the support hook 80 will be wedged between the side panel of the crossbar 88 and the surface of the leg 84.

Figure 6:
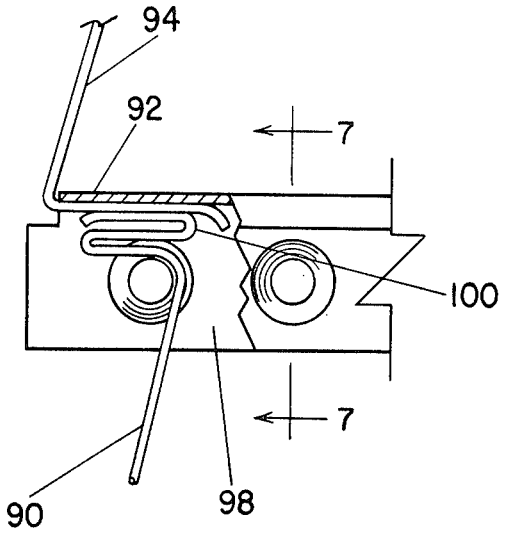
FIG. 6 is a side view partly in vertical section illustrating yet another alternative embodiment of the invention.
Figure 7:
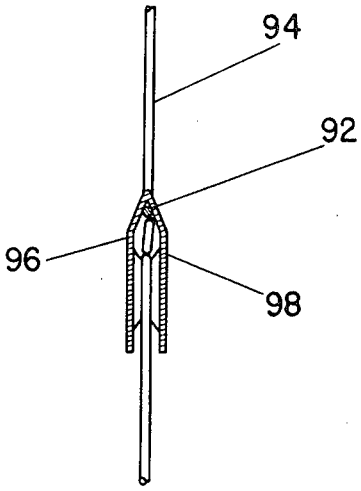
FIG. 7 is a view in vertical section taken substantially along the line 7—7 of FIG. 6.

FIGS. 6 and 7 illustrate yet another embodiment of the invention in which the sidebars are formed of a considerably smaller bar stock and used with a retaining means formed like the rack engaging portion of a support hook. With the embodiment illustrated in FIGS. 6 and 7, the small diameter leg 92 of the sidebar 94 is wedged in the groove 96 which was formed in the cross web of the crossbar 98. The leg 92 is held rigidly in this position by the upwardly directed force of the double looped rack engaging portion 100 of the lower sidebar 90.

The embodiments of the invention are assembled from the top down. Thus, the first two opposite sidebars are attached at their upper ends to the top crossbar. The next lower crossbar then receives the leg of each sidebar. Thereafter, the retaining means is inserted between the leg and its associated crossbeam to lock the sidebar and crossbar together.

Figure 8:
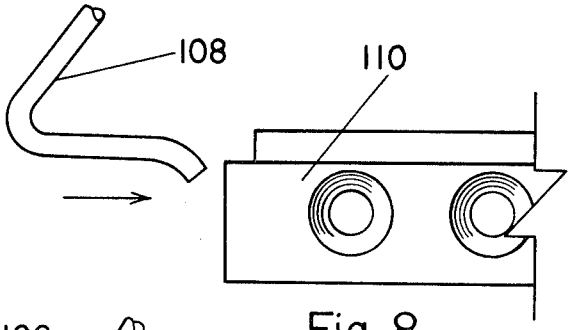
FIGS. 8, 9 and 10 are diagrammatic views illustrating the assembly of the preferred sidebars embodying the present invention.
Figure 9:
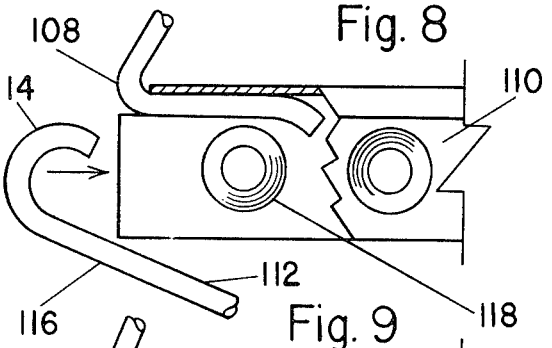
Figure 10:
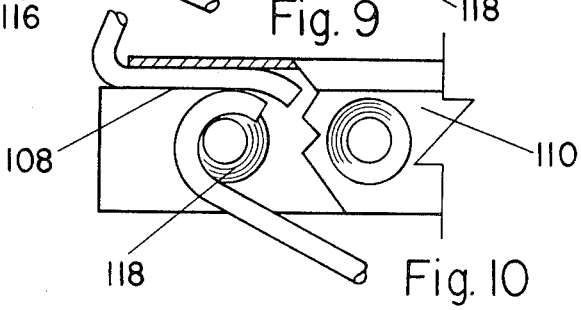

FIGS. 8 through 10 illustrate the insertion of the inwardly bent leg of a sidebar 108 into the crossbar 110 to the position illustrated in FIG. 9. Thereafter, the next crossbar 112 is inclined as illustrated so that the tip 114 of its hook-shaped end 116 may be inserted between the crossbeam 118 and the inwardly bent leg of sidebar 108 as illustrated in FIG. 10. The sidebar 112 is then pivoted or rotated about the center of the crossbeam 118 so that it then extends downwardly for attachment to the next lower crossbar in the identical manner. The finishing support rack embodying the present invention is disassembled in the opposite sequence, from the bottom up.

A plurality of sidebars may be prefabricated having considerably different lengths. For example, they may be constructed in lengths ranging from 4 to 36 inches at 2 inch intervals. Each sidebar will have an upper hook-shaped end and a lower inwardly extending leg in the same form as illustrated in FIG. 2. The only other difference besides length is that the angle between the inwardly extending leg and the nearly vertical portion of each sidebar is nearer 90° for the longer sidebars and becomes more acute as the sidebar is made shorter.

From the above it can be seen that the component parts of a support rack embodying the present invention may be prefabricated with sidebars of varying lengths. Crossbars, of course, may also be prefabricated in varying lengths and the hooks may be prefabricated in a variety of hook sizes and wire sizes and a variety of workpiece engaging shapes. When an order is received for finishing support racks with a particular size and crossbar spacings, the appropriate components are selected and packaged in a disassembled form for shipment to the purchaser. The purchaser then merely assemblies the component parts into the support rack which he ordered. He has the further option of ordering additional sidebars of different lengths so that he may thereafter change the painting support rack to accomodate different workpieces and different jobs.

One very important and major advantage of the structure of the present invention is that the interfacing surfaces of all the interlocking component parts of the support rack are protected and shielded within the crossbars. Therefore, electrical contact is maintained throughout the entire support rack despite the reuse of the support racks and the reuse of the component parts in different assemblies to form different support racks. The interlocking parts are kept free from the coating material which not only maintains the electrical contact but facilitates the disassembly and reassembly of the components because their mechanically engaging regions are uncoated.

A single-piece crossbar is formed which not only completely shields the electrical contact between the support hooks and both the crossbeam and cross web portions of the crossbar, but also provides rigid support for the entire rack. The hooks are directly releasable with a minimum of manual manipulation and movement. During use they are held rigidly in place under spring tension.

The simplicity with which the hooks may be removed and replaced and the simplicity of disassembly of the sidebars from the crossbars represents a significant labor and material savings. Because the structure is simpler, its cost of manufacture is low and because the shield serves two functions, both shielding and structural weight supporting, less metal is used, fewer parts are needed and therefore fewer parts are needed to be assembled during manufacture.

The groove and hook structure further permits the hooks and the sidebars to be constructed from a wide range of wire diameters and still seat rigidly but removably in the center of the grooves. This allows wire size to be custom selected for the size and weight of the workpieces.

Figure 11:
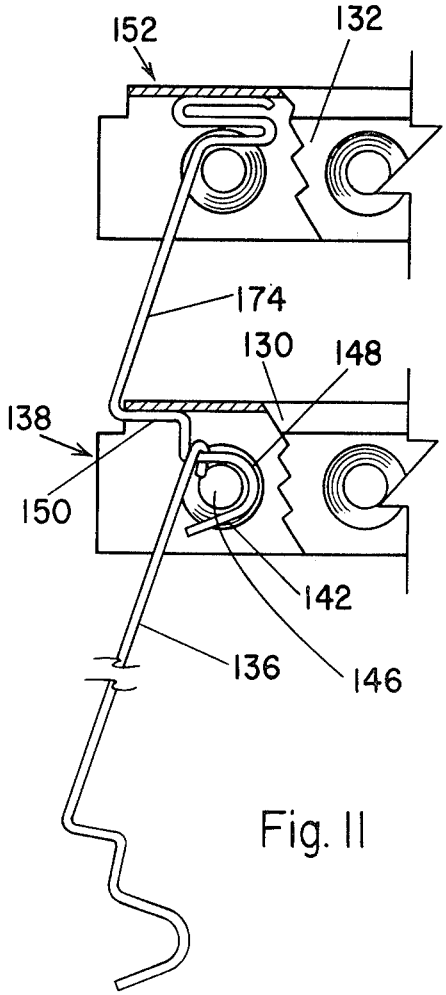
FIG. 11 is a view in vertical section of an alternative removable sidebar structure.

FIG. 11 illustrates still another alternative sidebar structure which provides the above advantages and is particularly suitable for sidebars constructed of relatively small wire or bar stock. The crossbars 130 and 132 and the entire support rack, except for the sidebars 134 and 136, are formed in exactly the same manner as described above.

The sidebars, however, are bent into a somewhat different shape and engage and lock with the crossbars in a different manner. The sidebars 134 and 136 both have their lower portions identically formed. Considering the sidebar 134 for example, it is formed with a lower end 138 which engages the end edge 140 of the associated sidebar 130, is bent to form a leg 142 which extends along the underside of the cross web 144 and above the crossbeam 146 and thereafter is bent around the inner side of the crossbeam 146 into a hook-shape portion 148.

The upper end of the sidebar 136 is formed with a hook-shape end 150 for hanging over a portion of the sidebar 134.

The sidebar 134 is dimensioned so that its hook-shaped lower end 148 seats against the interior side of the crossbeam 146 and also seats against the end edge of the crossbar 144. Its upper end 152 is engaged in the upper crossbar 132. Consequently, lateral movement of the crossbar 130 is prevented by the sidebar 134 as well as the sidebar provided at the opposite end of the support rack.

Most of the sidebars will have the upper hook end formed like the hook end 150 of the sidebar 136. This engagement of a relatively lower sidebar with the leg 142 of the relatively higher sidebar 134 further locks the sidebar 134 into its engagement with the crossbar 130.

However, the upper end of the topmost sidebars, such as the upper end 152 of the sidebar 134, will not have an available sidebar on which to hook. Therefore, the upper end 152 will be formed in the same manner as the upper end of the support hooks which are illustrated in FIG. 2 and will engage the cross web and crossbeams in the same manner.

The rack is assembled from the bottom up and disassembled from the top down.

Figure 12:
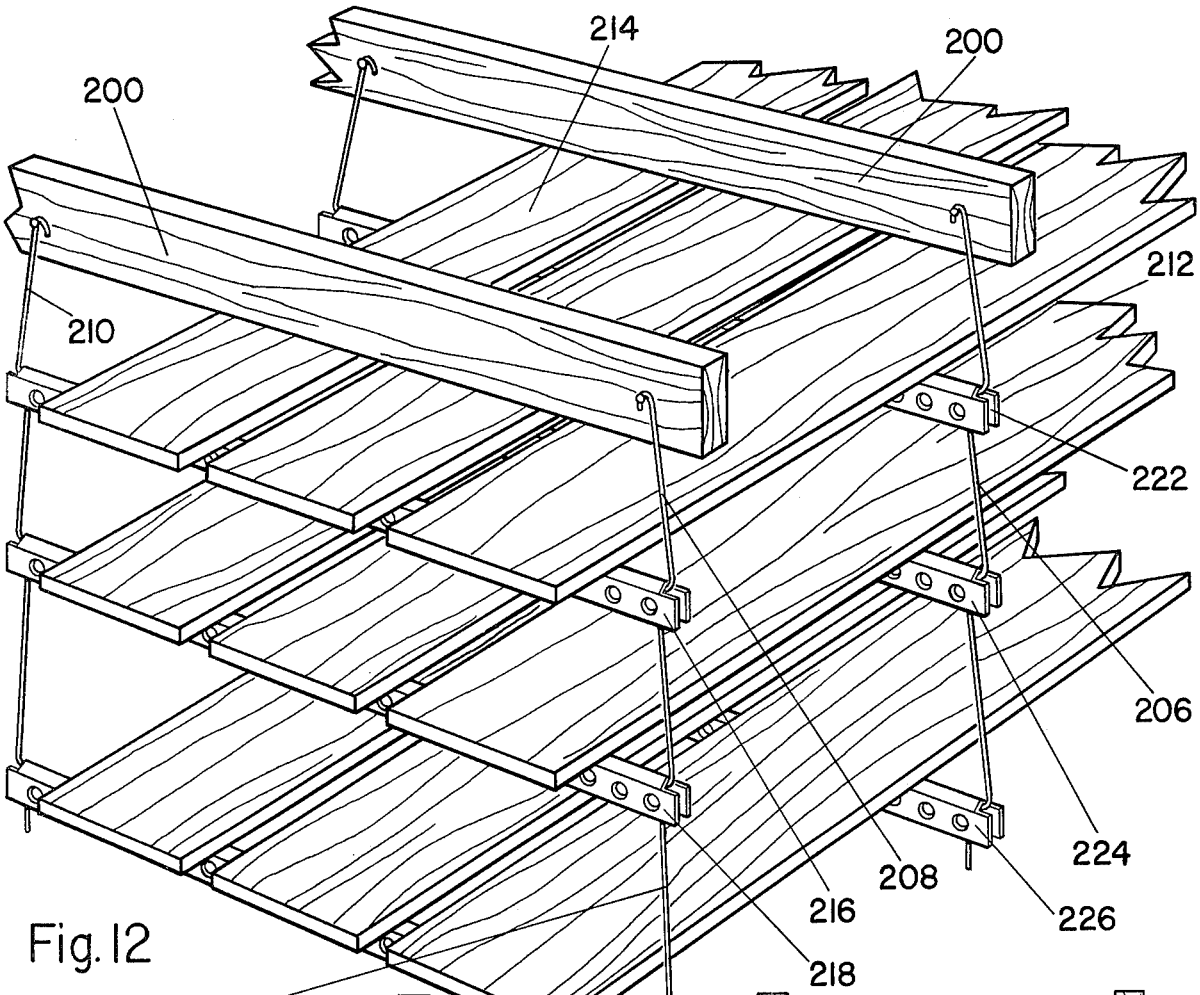
FIG. 12 is a view in perspective of a shelf embodying the present invention.

FIG. 12 shows a shelf embodying the present invention. It is suspended from a pair of joists or rafters 200, such as might be available in a home basement. The shelf has a pair of hangers 204 and 206 each constructed like the support rack illustrated in FIG. 1 with two exceptions. The hangers 204 and 206 do not have the article supporting hooks extending downward from their crossbars and they do not have a single upstanding conveyer hook. Although the hangers of FIG. 12 could be supported by a similar hook they are preferably supported by the use of two additional sidebars for each hanger, such as the sidebars 208 and 210 of the hanger 204.

Because the sidebars already have a hooked-shape at their upper end they are conveniently suited for fastening to the joist 200 or other shelf support by means of fasteners such as screws, bolts, nails or pins welded to structural steel. Most conveniently they are merely hung upon such fasteners so that they may be easily removed by lifting.

The hangers used for shelving consequently have the same advantages of ease of assembly and disassembly and variability of their spacing as described above in connection with the support rack.

Horizontal shelf panels such as wooden planks 212 and 214 extend transversely of and are supported on the crossbars 216, 218, 220, 222, 224 and 226 of the hangers.

Figure 13:
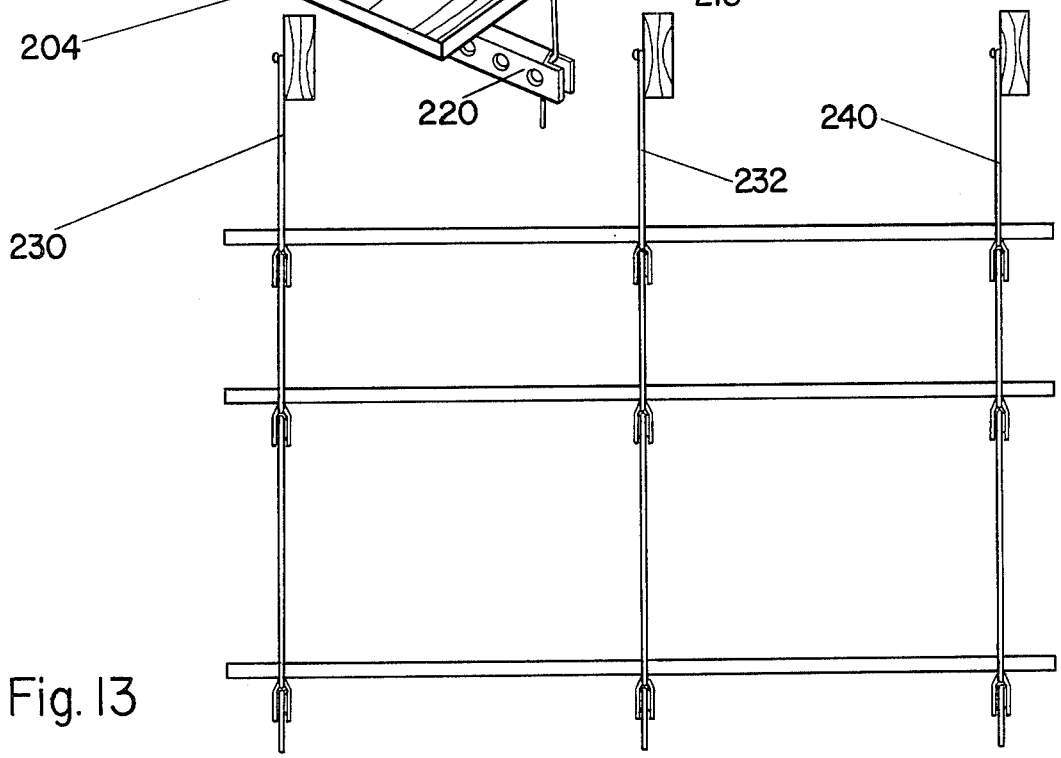
FIG. 13 is a view in vertical elevation of another shelf embodying the present invention.

FIG. 13 illustrates a shelf embodying the present invention utilizing three hangers 230, 232 and 240.

I claim:

1. A suspended, article supporting shelf comprising:

(a) a plurality of generally horizontal, vertically spaced crossbars each having opposed spaced panels, a cross web extending between and longitudinally along said panels and at least one crossbeam near each end of each crossbar extending between said panels and spaced from said cross web;

(b) a plurality of manually removable sidebars, some of said sidebars extending between the adjacent, vertically spaced ends of said crossbars and a pair of said sidebars extending upwardly from the uppermost one of said crossbars and fastened at their upper ends to a shelf support, each sidebar having an upper end which is bent around and shaped for hanging over an upper one of said crossbeams and a lower, inwardly bent leg extending along the underside of a cross web and above a crossbeam of a relatively lower one of said crossbars to a down turned tip;

(c) removable retaining means inserted between each of said lower legs and its associated crossbeam for extending from said crossbeam to said leg for preventing significant movement of said leg and interfering with said turned down tip to prevent withdrawal of said leg; and (d) horizontal shelf panels extending transversely of and supported on said crossbars.

2. A shelf in accordance with claim 1 wherein there is a second set of said crossbars, sidebars and retaining means as defined in claim 1 spaced from the first set for also supporting said shelf panels.

3. A rack in accordance with claim 1 wherein said retaining means comprises a hook-shaped upper end of another sidebar extending downwardly to another crossbar.

4. A suspended article supporting shelf comprising:

(a) a plurality of generally horizontal, vertically spaced crossbars each having opposed spaced panels, a cross web extending between and longitudinally along said panels and at least one crossbeam near each end of each crossbar extending between said panels and spaced from said cross web; and (b) a plurality of manually removable sidebars some of said sidebars extending between the adjacent, vertically spaced ends of said crossbars, and a pair of said side bars extending upwardly from the uppermost one of said crossbars and fastened at their upperends to a shelf support, each sidebar having a hookshaped upper end bent around and shaped for hanging over a relatively higher sidebar and a lower end engaging the end edge of an associated crossbar and bent to form a leg extending along the underside of the cross web and above a crossbeam of said associated crossbar and thereafter bent around the inner side of the crossbeam of said associated crossbar; and (c) removable retaining means inserted between each of said lower legs and its associated crossbeam for extending from said crossbeam to said leg for preventing significant movement of said leg and interfering with said turned down tip to prevent withdrawal of said leg.

5. A shelf in accordance with claim 4 wherein there is a second set of said crossbars and sidebars as defined in claim 4 spaced from the first set for also supporting said shelf panels.

* * * * *